US008167169B2

(12) United States Patent
Saunders et al.

(10) Patent No.: US 8,167,169 B2
(45) Date of Patent: May 1, 2012

(54) RESERVOIR FOR LIQUID DISPENSING SYSTEM WITH ENHANCED MIXING

(75) Inventors: Robert C. Saunders, Medford, MA (US); Brett M. Belongia, North Andover, MA (US)

(73) Assignee: EMD Millipore Corporation, Billerica, MA (US)

( * ) Notice: Subject to any disclaimer, the term of this patent is extended or adjusted under 35 U.S.C. 154(b) by 0 days.

(21) Appl. No.: 12/985,005

(22) Filed: Jan. 5, 2011

(65) Prior Publication Data

US 2011/0120565 A1 May 26, 2011

Related U.S. Application Data

(62) Division of application No. 11/649,576, filed on Jan. 4, 2007, now Pat. No. 7,950,547.

(60) Provisional application No. 60/758,296, filed on Jan. 12, 2006.

(51) Int. Cl.
*B67D 1/00* (2006.01)

(52) U.S. Cl. ..... 222/64; 222/424; 266/136

(58) Field of Classification Search ..... 222/63, 222/64, 107, 318, 251, 424, 109; 366/136, 366/137, 152.1, 153.1; 137/393, 337, 340, 137/454.4

See application file for complete search history.

(56) References Cited

U.S. PATENT DOCUMENTS

| | | | |
|---|---|---|---|
| 1,947,851 | A | 2/1934 | Jewett |
| 2,764,722 | A | 9/1956 | McKeown |
| 3,185,348 | A | 5/1965 | Pollak et al. |
| 3,570,715 | A | 3/1971 | Evers |
| 3,642,047 | A | 2/1972 | Waage |
| 3,790,029 | A | 2/1974 | Ward |
| 3,815,822 | A | 6/1974 | Davies et al. |
| 4,026,669 | A | 5/1977 | Leonard et al. |
| 4,069,841 | A | 1/1978 | Bartlett |
| 4,107,267 | A | 8/1978 | Hansen |
| 4,276,270 | A | 6/1981 | Gragg |
| 4,322,298 | A | 3/1982 | Persidsky |
| 4,396,383 | A | 8/1983 | Hart |
| 4,493,705 | A | 1/1985 | Gordon et al. |
| 4,568,428 | A | 2/1986 | Rigg et al. |
| 4,608,178 | A | 8/1986 | Johansson et al. |
| 4,621,928 | A | 11/1986 | Schreiber |
| 4,718,462 | A | 1/1988 | Fix |

(Continued)

FOREIGN PATENT DOCUMENTS

| | | | |
|---|---|---|---|
| CA | 2051438 | A1 | 10/1990 |

(Continued)

OTHER PUBLICATIONS

Final Rejection mailed Sep. 15, 2011in co-pending U.S. Appl. No. 12/283,797.

(Continued)

*Primary Examiner* — Lien Ngo
(74) *Attorney, Agent, or Firm* — Nields, Lemack & Frame, LLC

(57) ABSTRACT

Reservoir for a dispense system designed to maintain a suspending fluid flow within the reservoir. The fluid dispense system is particularly well suited to be manufactured in a single-use format comprising a fluid reservoir and fill tube assembly, particularly comprising a reservoir, tubing, fittings and connectors, and a needle. The system ensures uniformity within the liquid by moving the fluid through the product reservoir such as with a continuous or pulsating flow, and is designed to maintain the fluid in motion in order to maintain a homogenous solution. The reservoir is designed to minimize any fluid dead zones.

6 Claims, 3 Drawing Sheets

U.S. PATENT DOCUMENTS

| | | | |
|---|---|---|---|
| 4,734,269 | A | 3/1988 | Clarke et al. |
| 4,793,515 | A | 12/1988 | Shannon et al. |
| 4,857,355 | A | 8/1989 | Gregg |
| 4,863,454 | A | 9/1989 | Labove |
| 4,976,707 | A | 12/1990 | Bodicky et al. |
| 5,004,571 | A | 4/1991 | Litz et al. |
| 5,114,045 | A | 5/1992 | Herpe |
| 5,121,857 | A | 6/1992 | Hutchinson |
| 5,137,175 | A | 8/1992 | Kowalski et al. |
| 5,251,982 | A | 10/1993 | Stenstrom et al. |
| 5,445,193 | A | 8/1995 | Koeninger et al. |
| 5,480,063 | A | 1/1996 | Keyes et al. |
| 5,490,809 | A | 2/1996 | Jones et al. |
| 5,493,765 | A | 2/1996 | Klebl et al. |
| 5,538,462 | A | 7/1996 | Gnadt |
| 5,570,815 | A | 11/1996 | Ramsay |
| 5,680,960 | A | 10/1997 | Keyes et al. |
| 5,683,508 | A | 11/1997 | Bleiler et al. |
| 5,697,407 | A | 12/1997 | Lasonde |
| 5,810,037 | A | 9/1998 | Sasaki et al. |
| 5,957,759 | A | 9/1999 | Cardenas et al. |
| 6,027,240 | A | 2/2000 | Han |
| 6,053,885 | A | 4/2000 | Beshel |
| 6,079,633 | A | 6/2000 | Inoue et al. |
| 6,138,724 | A | 10/2000 | Rivera et al. |
| 6,183,460 | B1 | 2/2001 | Smith et al. |
| 6,186,193 | B1 | 2/2001 | Phallen |
| 6,203,667 | B1 | 3/2001 | Huhtelin |
| 6,293,849 | B1 | 9/2001 | Kawashima |
| 6,491,679 | B1 | 12/2002 | Okamoto et al. |
| 6,726,771 | B2 | 4/2004 | Ueda |
| 6,779,685 | B2 | 8/2004 | Nelson |
| 7,275,928 | B2 | 10/2007 | Kolesar et al. |
| 7,396,497 | B2 | 7/2008 | Koetas et al. |
| 7,810,674 | B2 | 10/2010 | Belongia |
| 7,950,547 | B2 | 5/2011 | Saunders et al. |
| 8,118,191 | B2 | 2/2012 | Belongia et al. |
| 2002/0147440 | A1 | 10/2002 | Samolyk |
| 2003/0198125 | A1 | 10/2003 | Linsen et al. |
| 2004/0164092 | A1 | 8/2004 | DiLeo |
| 2005/0029301 | A1 | 2/2005 | Belongia |
| 2005/0146982 | A1 | 7/2005 | Carlson et al. |
| 2005/0284882 | A1 | 12/2005 | Belongia |
| 2007/0064519 | A1 | 3/2007 | Neumann |
| 2010/0230365 | A1 | 9/2010 | Hill et al. |
| 2011/0206540 | A1 | 8/2011 | Belongia et al. |

FOREIGN PATENT DOCUMENTS

| | | | |
|---|---|---|---|
| CN | 1047813 | A | 12/1990 |
| DE | 670057 | C | 1/1939 |
| DE | 1472745 | A | 2/1972 |
| EP | 0440310 | A1 | 8/1991 |
| EP | 1750103 | A2 | 7/2006 |
| FR | 2411318 | A1 | 7/1979 |
| GB | 652142 | A | 4/1951 |
| GB | 731815 | A | 6/1955 |
| GB | 891334 | A | 3/1962 |
| JP | 2002-113342 | A | 4/2002 |
| NL | 7901305 | A | 8/1980 |
| WO | 82/03797 | A1 | 11/1982 |
| WO | 91/10615 | A1 | 7/1991 |
| WO | 03/002590 | A2 | 1/1993 |
| WO | 01/28889 | A1 | 4/2001 |
| WO | 03/002590 | A2 | 1/2003 |
| WO | 2005/011852 | A1 | 2/2005 |

OTHER PUBLICATIONS

CN communication, with English translation, dated Jul. 25, 2008 in co-pending foreign application No. 200610108574.6/ U.S. Appl. No. 11/189,358.

English translation of CN communication dated Mar. 20, 2009 in co-pending foreign application No. 200610108574.6/ U.S. Appl. No. 11/189,358.

English translation of CN communication dated Jul. 3, 2009 cited in co-pending foreign application No. 200610108574.6/U.S. Appl. No. 11/189,358.

English translation of CN communication dated Nov. 6, 2009 cited in corresponding foreign application No. 200710084247.6 / U.S. Appl. No. 11/649,576.

English translation of CN communication dated Nov. 13, 2009 cited in co-pending foreign application No. 200610108574.6 /U.S. Appl. No. 11/189,358.

EP communication dated Jun. 8, 2007 cited in corresponding foreign application No. EP 07250100.0/ U.S. Appl. No. 11/649,576.

EP communication dated Aug. 24, 2007 in corresponding foreign application EP07250100.0/ U.S. Appl. No. 11/649,576.

EP communication dated Oct. 2, 2007 in co-pending foreign application EP06253702.2/ U.S. Appl. No. 11/189,358.

EP communication dated Feb. 18, 2008 in co-pending foreign application EP06253702.2/ U.S. Appl. No. 11/189,358.

EP communication dated Mar. 12, 2009 in co-pending foreign application EP06253702.2/ U.S. Appl. No. 11/189,358.

EP communication dated Mar. 17, 2009 in co-pending foreign application EP09152824.0/ U.S. Appl. No. 12/283,787.

EP communication dated Mar. 18, 2009 in co-pending foreign application EP09151128.7/ U.S. Appl. No. 12/283,787.

EP communication dated Jul. 31, 2009 in co-pending foreign application EP09152824.0/ U.S. Appl. No. 12/283,787.

EP communication dated Sep. 8, 2009 in co-pending foreign application EP06253702.2/ U.S. Appl. No. 11/189,358.

EP communication dated Feb. 5, 2010 in co-pending foreign application EP 09152824.0/ U.S. Appl. No. 12/283,787.

EP communication dated Jul. 12, 2010 in co-pending foreign application EP09151128.7/ U.S. Appl. No. 12/283,787.

EP communication dated Jul. 12, 2010 in co-pending foreign application EP06253702.2/ U.S. Appl. No. 11/189,358.

Indian communication dated Jun. 24, 2008 in co-pending foreign application IN1543/DEL/2006.

Indian communication dated Jul. 16, 2010 in corresponding foreign application IN59/DEL12007.

Internet citation Oct. 30, 2003, pp. 104, XP002382559, "Fortschrittlische Herstellungsprozesse fur halbfeste produkte", in co-pending foreign application EP 06253702.2 / U.S. Appl. No. 11/189,358.

Internet citation Oct. 15, 2007, pp. 1-2, XP002451276, "Peristaltic Pump", Wikipedia, in co-pending foreign application EP 06253702.21 / U.S. Appl. No. 11/189,358.

Japanese communication, with English translation, dated Oct. 27, 2009 in corresponding foreign application No. JP-2007-003366.

English translation of Japanese communication dated Jul. 27, 2010 in corresponding foreign app. JP-2007-003366.

Singapore communication dated Jan. 19, 2010 in corresponding foreign application No. SG 200700147-2.

Office Action Nov. 29, 2010 in co-pending U.S. Appl. No. 12/283,797, filed Sep. 16, 2008.

Office Action Jun. 30, 2009 in corresponding U.S. Appl. No. 11/649,576, filed Jan. 4, 2007.

Office Action Dec. 16, 2009 in corresponding U.S. Appl. No. 11/649,576, filed Jan. 4, 2007.

Office Action May 27, 2010 in corresponding U.S. Appl. No. 11/649,576, filed Jan. 4, 2007.

Notice of Allowance Nov. 30, 2010 in corresponding U.S. Appl. No. 11/649,576, filed Jan. 4, 2007.

Notice of Allowance Feb. 3, 2011 in corresponding U.S. Appl. No. 11/649,576 filed Jan. 4, 2007.

Notice of Allowance mailed Dec. 16, 2011 in co-pending U.S. Appl. No. 12/283,797 (now US Patent No. 8,118,191).

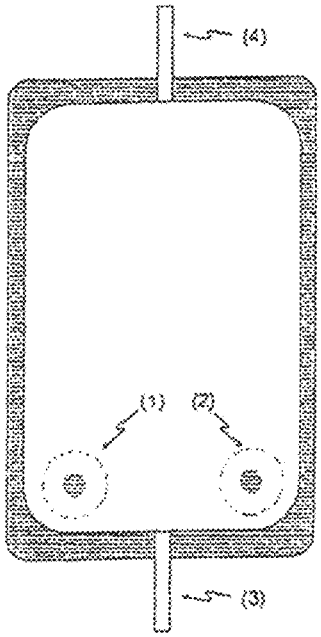
Figure 5a. Reservior design 5a.
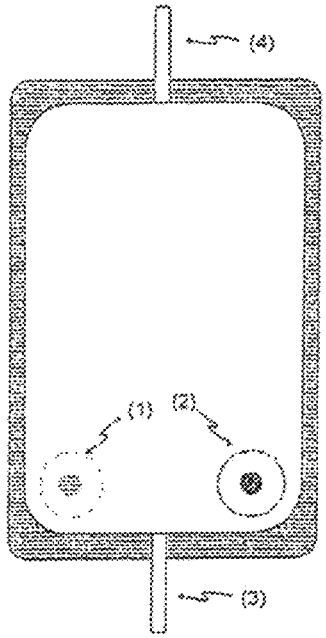
Figure 5b. Reservoir design 5b.
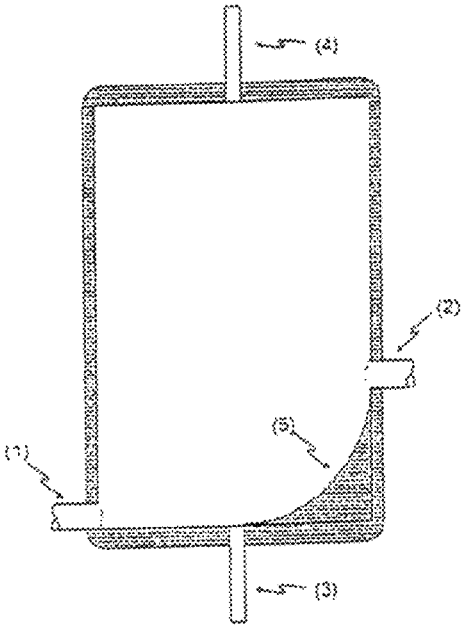
Figure 6. Reservoir design 6.
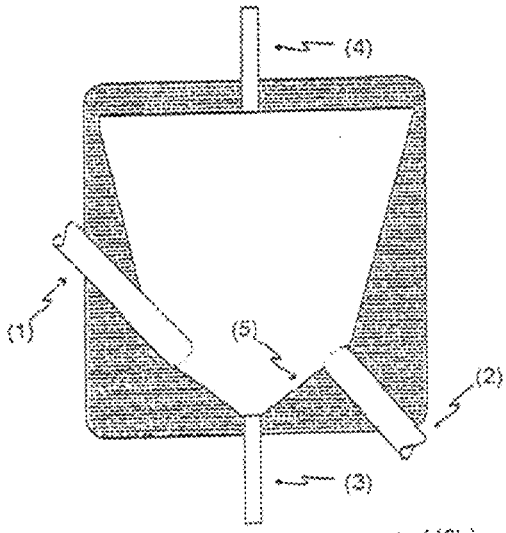
Figure 7. Reservoir design 7. Placement of (2) is arbitrary.

RESERVOIR FOR LIQUID DISPENSING SYSTEM WITH ENHANCED MIXING

This application is a divisional of U.S. Ser. No. 11/649,576 filed Jan. 4, 2007, which claims priority of U.S. Provisional application Ser. No. 60/758,296 filed Jan. 12, 2006, the disclosures of which are incorporated herein by reference.

BACKGROUND OF THE INVENTION

There are various types of dispensing apparatuses for filling parenteral and ophthalmic products into vials and containers. One such type is positive displacement fillers. These devices employ a cylinder and piston arrangement, which contacts and dispenses the fluid. Typically, fluid enters the cylinder as the piston is in its upward motion, which creates a vacuum into which the fluid enters through an inlet port. The downward motion of the piston expels the fluid through an outlet port. The process can then be repeated. Other embodiments of positive displacement fillers also exist, such as those using rotary pumps.

While these fillers are popular due to their speed and accuracy, their application is limited, especially in the pharmaceutical field. These devices are very difficult to clean, and typically must be disassembled to be sterilized. Also, since the device actually contacts the fluid, contamination is a constant risk.

Another type of dispensing apparatus is the time/pressure filler. These typically include a fluid chamber that is held under constant pressure. Fluid is dispensed through a discharge line, which is controlled by a pinch type valve. The valve is opened for a precise amount of time to dispense fluid. Since the pressure is held constant, and the time interval is constant, the amount of fluid dispensed should also be constant. However, due to variances in the equipment and deformation of the discharge tube over time, these systems are less accurate than required for many applications.

A third type of dispensing apparatus is the volumetric dispensing apparatus, as shown in U.S. Pat. Nos. 5,680,960, 5,480,063, and Publication No. 2005-0029301, which are hereby incorporated by reference. These devices measure and dispense a predetermined volume of fluid. These systems are highly accurate and avoid problems of contamination common with positive displacement apparatus, since there are no moving parts in contact with the fluid.

The above mentioned apparatus can all be used to dispense single-phase fluids but all of the apparatus described suffer from one or more significant drawbacks when dispensing solids dispersed in liquid (suspensions) or droplets of one liquid suspended in another liquid (emulsions). Suspension products, such as vaccines or steroid products may settle when not properly agitated. In the case of emulsions, the two liquids will form droplets when they are agitated but when agitation stops, the droplets may separate into two separate layers. Either of these cases will result in poor content uniformity from one vial to the next during the final dispensing of the product.

In addition, it can be difficult to clean the process equipment that has contained suspensions or emulsions, resulting in labor intensive cleaning procedures and significant downtime to change from one batch to another. Since the final drug product must remain sterile, rigorous aseptic processes must be adhered to in the reassembly of the dispensing apparatus.

It is therefore an object of the present invention to provide a dispensing system and a reservoir therefore that has provision for the mixing of suspension and emulsion products, while maintaining the integrity of the system so that sterility is not negatively impacted. It is also an objective of this invention to minimize the amount of time spent cleaning the delivery system therefore minimizing the amount of downtime required.

SUMMARY OF THE INVENTION

The problems of the prior art have been overcome by the present invention, which provides a reservoir for a dispense system designed to maintain a suspending fluid flow within the reservoir. The system is particularly suitable for installation into a host apparatus for dispensing suspensions or emulsions. The fluid dispense system is particularly well suited to be manufactured in a single-use format comprising a fluid reservoir and fill tube assembly, particularly comprising a reservoir, tubing, fittings and connectors, and a needle. The system ensures uniformity within the liquid by moving the fluid through the product reservoir such as with a continuous or pulsating flow. The system is designed to maintain the fluid in motion in order to maintain a homogenous solution. The reservoir is designed to minimize any fluid dead zones.

BRIEF DESCRIPTION OF THE DRAWINGS

FIG. 5A is a schematic diagram showing yet another embodiment of a reservoir in accordance with the present invention;

FIG. 5B is a schematic diagram showing another embodiment of a reservoir in accordance with the present invention;

FIG. 6 is a schematic diagram showing yet another embodiment of a reservoir in accordance with the present invention;

FIG. 7 is a schematic diagram showing another embodiment of a reservoir in accordance with the present invention.

DETAILED DESCRIPTION OF THE INVENTION

The dispense system described here consists of a single-use dispense cartridge and a hardware component onto which the dispense cartridge can be installed. The hardware system is described in the prior art (U.S. Pat. Nos. 5,680,960 and 5,480,063, the disclosures incorporated herein by reference). The present invention provides for a novel reservoir that allows for a suspending fluid flow within the reservoir.

Preferably the fluid reservoir section of the dispense cartridge is a pliable or flexible chamber or bladder, which expands and contracts to maintain a constant internal pressure. Disposable bag-like enclosures are particularly suitable, constructed of flexible polymer-laminate film and sealed, such as thermally, at seams and port insertion points.

The tubing section of the dispense cartridge consists of flexible tubing such as silicone, polyethylene, or other elastomer or polymer based tubing attached together with plastic connectors made of materials such as polyethylene, polypropylene, or poly-fluorocarbons.

Figure 8:
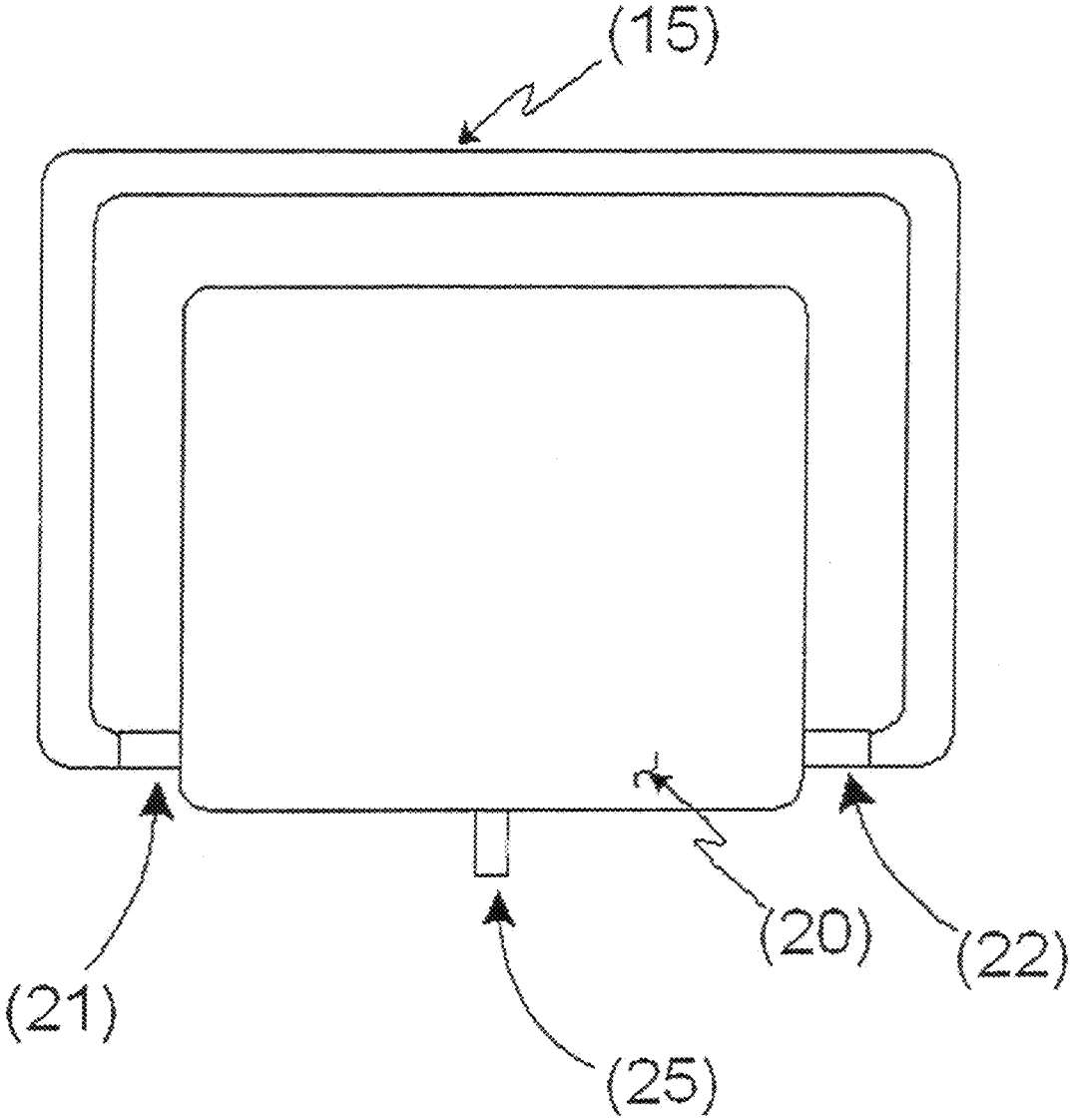
FIG. 8 is a schematic diagram showing an embodiment of a dispense cartridge.

Turning first to FIG. 8, an embodiment of a dispense cartridge which can contain the reservoir of the present invention is shown. An inlet (21) and outlet (22) port on the reservoir (20) are connected with a tubing loop (15). A port (25) on the bottom of the reservoir (20) is provided to allow liquid to move to the tubing assembly used to deliver the product to its final containers (not shown) A single-loop dispensing system, including a feed pump (such as a peristaltic pump) in fluid communication with a well mixed, bulk fluid supply source and with the inlet or fill port of the fluid reservoir of the dispense cartridge, and a draw pump in fluid communication with an outlet of reservoir of the dispense cartridge and the feed to the well mixed bulk fluid supply source, can be used. Alternatively, a circulation-loop scheme can be used to maintain flow through the dispense cartridge. A non-invasive pump, such as a peristaltic pump, circulates the product through a tubing loop in fluid communication with an inlet and outlet of the reservoir of the dispense cartridge. Thus, the intake of the pump is in fluid communication with an outlet of the reservoir of the dispense cartridge, and the outtake of pump is in fluid communication with an inlet of the reservoir of the dispense cartridge. The pump is preferably on continuously during operation of the system to maintain the fluid in motion. This configuration requires that the pressure in the well mixed, bulk fluid supply source, at the transfer point, be greater than the pressure on the other side of the valve. This can be accomplished in any number of ways, such as by using gravity by elevating the bulk fluid supply source or by pressurizing the bulk fluid supply source or by introducing a Venturi restriction on the reservoir side of the valve in line with the reservoir re-circulation loop.

A level sensor such as an optical sensor or capacitance sensor can be used to monitor the fluid level in the reservoir of the dispense cartridge, and the pump speeds may be controlled thereby to maintain a consistent fluid level. Alternatively, a level switch can be used, in which case the pumps may be controlled in an on/off fashion.

Alternatively still, an alternating or reversing pump can be used to maintain flow and mixing in the reservoir. A single peristaltic pump, capable of reversing direction, is in fluid communication with both the bulk fluid supply source and the reservoir of the dispense cartridge through suitable tubing. The fluid level in the reservoir of the dispense cartridge is monitored, such as with a level switch. When the fluid level in the reservoir reaches a predetermined level, the pump remains on but alternates direction so that product is alternately pumped into and out of the reservoir on a periodic or continuous basis. If the level in the reservoir of the dispense cartridge falls below the predetermined level, the pump is placed in a single direction mode to fill the reservoir to the desired level, and is then again placed in the alternating mode to alternately pump product into and out of the reservoir to maintain flow and prevent the solids from settling. In the event the withdrawal of fluid from the reservoir of the dispense cartridge does not mix the reservoir contents as efficiently as the filling of the reservoir, the speed of the pump may also alternate in accord with the pump direction so that the time that the pump is withdrawing fluid is less than 50% of the pump cycle time or the cycle time may be minimized.

Figure 1:
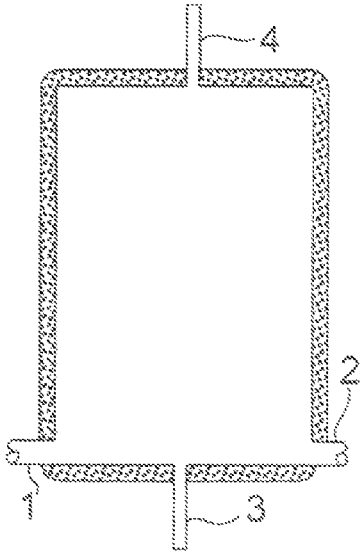
FIG. 1 is a schematic diagram showing one embodiment of a reservoir in accordance with the present invention.

Turning now to FIG. 1, there is shown an embodiment of the reservoir (20) section of the dispense cartridge. The reservoir 20 has a rectangular profile, with an arbitrary aspect ratio to be determined by the maximum rate of flow and the settling properties of the particular product to be dispensed. The reservoir is formed by thermally sealing polymer film. Feed port (1) and return port (2), through which recirculation of the contents occurs, are coaxial and opposite, and both ports adjoin the lower thermal seam of the reservoir such that there is no gap between the ports and the seam. A fill port (3) is provided by sealing it into the reservoir bag at a right angle, as is opposite headspace port (4). The fill port (3) connects to the bottom of the sight tube (not shown) of the dispensing system, and the headspace port (4) connects to the top of the sight tube.

Figure 2:
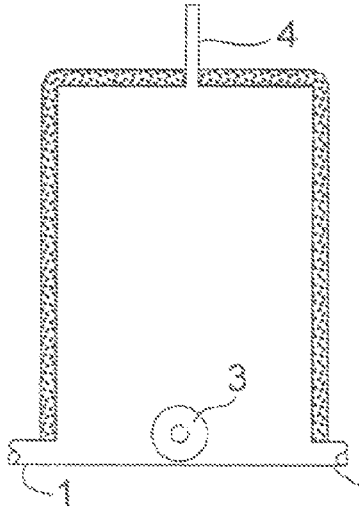
FIG. 2 is a schematic diagram showing another embodiment of a reservoir in accordance with the present invention.
Figure 2A:
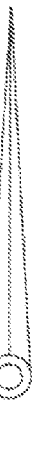
FIG. 2A is a side view of the reservoir of FIG. 2.

FIGS. 2 and 2A illustrate another embodiment of the reservoir, where it is made of a single piece of plastic laminate film that is folded over at the bottom and sealed. The feed port (1) and return port (2) adjoin the lower fold such that the film is wrapped around the radius of the ports, which must be the same for both ports. The fill port (3) (FIG. 2, but not shown in FIG. 2A) is connected to the reservoir using a face-mounted port connection in order to avoid deforming the seam. Headspace port (4) is again positioned opposite fill port (3) at a right angle as in the FIG. 1 embodiment.

Figure 3:
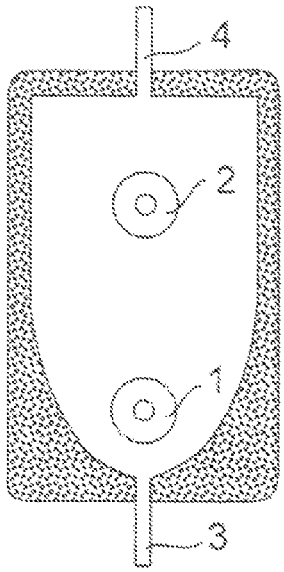
FIG. 3 is a schematic diagram showing yet another embodiment of a reservoir in accordance with the present invention.

FIG. 3 illustrates a reservoir embodiment that does not have a rectangular profile, but rather is parabolic. In this embodiment, the feed port (1) is positioned at the focus of a conic section profile (5), created by thermal sealing of the lower portion of the bag. Both the feed port (1) and the return port (2) can be mounted to the reservoir using face-port connections. The fill port (3) and the headspace port (4) are connected as in FIG. 1.

Figure 4:
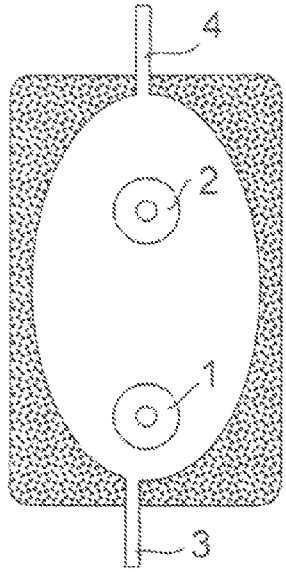
FIG. 4 is a schematic diagram showing another embodiment of a reservoir in accordance with the present invention.

FIG. 4 illustrates a similar design, except that the conic section (5) is shaped as an ellipse, with the feed port (1) and the return port (2) located at the opposite foci of the ellipse. The fill port (3) and the headspace port (4) are connected as in FIG. 1.

FIG. 5A illustrates a reservoir with a rectangular profile, except that the edges are rounded. In this embodiment, the feed port (1) and return port (2) are mounted on the same side of the reservoir such as by using face ports in the lower corners of the reservoir. Preferably the ports (1) and (2) are horizontally aligned, and are placed at the center of curvature of the bag seal corners. The fill port (3) and the headspace port (4) are connected as in FIG. 1. FIG. 5B illustrates a similar embodiment, except that the ports (1) and (2) are mounted on opposite sides of the reservoir (but again at the same horizontal locations).

As illustrated in FIG. 6, the configuration of the reservoir need not be symmetric. The bag seal profile (5) of FIG. 6 is an asymmetric design, and fills the reservoir corner opposite from the feed port (1). The profile (5) is designed to eliminate regions of slow flow in the distal portions of the reservoir, such as by directing the fluid jet produced by the feed port (1). The location of the return port (2) in this embodiment is not particularly limited, although it is preferably located in side of the reservoir opposite from the feed port (1) side. The fill port (3) and the headspace port (4) are connected as in FIG. 1.

FIG. 7 illustrates yet another asymmetric design. In this embodiment, the feed port (1) and the return port (2) are placed at angles other than 90° to the edge of the reservoir bag. The actual angle used should be one that improves the efficiency of mixing along the lower seam of the reservoir, such as 45° from the vertical axis of the bag for both the feed and return ports (which are, in turn, 180° from each other), particularly for a non-rectilinear reservoir such as the one shown. The position and angle of the return port (2) must be below the liquid level in the bag in order to ensure proper operation.

The existence and placement of the feed and return ports on every bag design permits the suspension to be mixed without a shaft penetration/seal on the bag. On certain bag designs, such as those shown in FIGS. 3, 4, 6 and 7, the geometry of the perimeter seal of the bag has been designed to create a fluid flow profile that improves the specific ability of the system to maintain the suspension of settling materials.

What is claimed is:

1. A method of maintaining a suspension or emulsion in a homogenous condition, comprising: providing a well-mixed fluid supply source;

providing a fluid reservoir, said fluid reservoir comprising a pliable chamber capable of expanding and contracting to maintain a constant internal pressure, said fluid reservoir having an inlet and an outlet;

maintaining said fluid in motion by continuously pumping fluid from said supply source to said fluid reservoir through said inlet and from said reservoir to said supply source via said outlet; and maintaining a consistent fluid level in said reservoir by controlling the pumping speed.

2. The method of claim 1, wherein said pumping is carried out by a first pump in fluid communication with said supply source and said inlet, and a second pump in fluid communication with said outlet and said supply source.

3. The method of claim 2, wherein said first and second pumps are peristaltic pumps.

4. The method of claim 1, further comprising determining the level of fluid in said reservoir, and wherein said consistent fluid level is maintained in said reservoir in response to said determined level of fluid.

5. The method of claim 1, wherein said reservoir is formed by thermally sealing polymer film.

6. The method of claim 5, wherein thermally sealing said polymer film creates a seam, and wherein said inlet and outlet adjoin said seam such that there is no gap between said inlet and said seam and said outlet and said seam.

* * * * *